US005271449A

United States Patent [19]

Herrick

[11] Patent Number: 5,271,449

[45] Date of Patent: Dec. 21, 1993

[54] DETACHABLE BARRIER FOR A DOORWAY

[76] Inventor: Douglas J. Herrick, N2919 Smokey Hollow Rd., Poynette, Wis. 53955

[21] Appl. No.: 893,170

[22] Filed: Jun. 3, 1992

[51] Int. Cl.[5] ..... E06B 3/00

[52] U.S. Cl. ..... 160/368.1; 160/354

[58] Field of Search ..... 160/368.1, 354, 370.2, 160/327, 369; 52/202

[56] References Cited

U.S. PATENT DOCUMENTS

| | | | |
|---|---|---|---|
| 3,251,399 | 5/1966 | Grossman | 160/368.1 X |
| 3,455,366 | 7/1969 | Bogumil | 160/368 |
| 3,753,458 | 8/1973 | Lazarek | 160/368.1 X |
| 3,763,917 | 10/1973 | Antinone . | |
| 4,100,957 | 7/1978 | Shelton | 160/368.1 |
| 4,249,589 | 2/1981 | Loeb . | |
| 4,653,566 | 3/1987 | Miale . | |
| 4,673,019 | 6/1987 | Silverthorne . | |
| 4,712,598 | 12/1987 | Bonacci et al. . | |
| 4,846,241 | 7/1989 | Chomka . | |
| 4,909,004 | 3/1990 | Panttila | 52/208 |
| 5,035,460 | 7/1991 | Huang | 160/370.2 |
| 5,050,660 | 9/1991 | Bleichwehl . | |
| 5,174,353 | 12/1992 | Schmeichel et al. | 160/368.1 |

*Primary Examiner*—David M. Purol

*Attorney, Agent, or Firm*—Lathrop & Clark

[57] ABSTRACT

A system for providing a detachable barrier, preferably a screen barrier, on a doorway, garage opening or the like is provided. The barrier may be removably attached and adjusted to provide a custom-fit appearance.

2 Claims, 2 Drawing Sheets

DETACHABLE BARRIER FOR A DOORWAY

FIELD OF THE INVENTION

The present invention is generally directed to a detachable barrier for an opening, such as a garage door opening, doorway or the like. The present invention is more particularly directed to a screened enclosure, which can be removably attached to an opening.

DESCRIPTION OF THE PRIOR ART

Rooms, offices, suites, garages and the like (hereafter generally referred to as "rooms") all have entrances or openings to access the interior of the room. For purposes of the present invention, the term "opening" is used to refer to the entrance into a room. Although an opening presumes an entrance, it is also within the scope of the present invention to provide a barrier as a room divider.

At times there is a need for a barrier or closure for selectively inhibiting total or partial access through the opening. While the term "total access" is self-explanatory, the term "partial access" is defined as the access of certain desirable elements, e.g., air, light, sound, etc., while inhibiting certain undesirable elements, e.g., dust, insects, etc. A standard garage door and a hinged door are examples of barriers which may prevent total access to a room. On the other hand, a screened barrier allows selective access for element such as air and light, and yet inhibits the passage of insects and other elements.

Most room openings include a semi-permanent barrier, such as a standard hinged door or a garage door. The barrier can also be in the form of a screen door. These barriers are attached to the opening by hinges, tracks or other means known to the art.

It is sometimes desirable to provide an alternative type of barrier, which can be readily attached, removed and reattached at will and provide additional features to customize the opening. For example, in a doorway system which does not include a screen opening, it might be desirable to attach a temporary screen barrier to the doorway system. The temporary barrier will allow air and light to enter the room or garage, but prevent the entry of insects. The temporary barrier can also serve as a safety enclosure to prevent children, pets and the like from escaping the enclosed area, while still providing an atmospherically-desirable area.

There are barriers known to the art which achieve this purpose. For example, reference is made to U.S. Pat. Nos. 5,050,660 to Bleichwehl et al., 4,846,241 to Chomka et al., 4,712,598 to Bonacci et al., 4,673,019 to Silverthorne et al., and 4,653,566 to Miale, which disclose a roll-up type of screen barrier for a garage door or the like. Additionally, U.S. Pat. Nos. 4,249,589 to Loeb and 3,763,917 to Antinone illustrate devices which may be attached to a door or window opening to provide a temporary screen. The temporary screen is attached by means of snaps, hook and pile securing mechanisms or the like.

While the above-referenced devices may achieve the desired purpose, they have some undesirable features. For example, the roll-up screens require a considerable amount of equipment attached to the door in order to operate effectively. Additionally, many of the roll-up screens are attached to the opening on more-or-less a semi-permanent basis. The snap-on screen barriers of the prior art must be constructed according to strict dimensions in order to be placed on the opening, without giving a wrinkled appearance or allowing access holes around the borders of the screen for the passage of insects or the like.

SUMMARY OF THE INVENTION

The present invention overcomes these deficiencies by providing a system for mounting a detachable barrier or closure to an opening with a minimum amount of equipment. The opening includes a frame having a defined height and width and a plurality of elongated sections bordering the frame. The system comprises a flexible barrier material having a body defined by opposing top and bottom edges and opposing side edges. The edges are adapted to detachably connect to the elongated sections of the frame. The system further includes first attachment means on the elongated sections for detachably attaching the edges of the barrier material to the elongated sections of the detachable barrier. Additionally, second attachment means are provided on the edges of the barrier material. The second attachment means are adapted to coact with the first attachment means to detachably attach to barrier material to the frame. The system also includes means to adjust the length of the edges of the barrier material to customize the fit of the barrier material to the defined height and width of the frame.

One advantage of the barrier system of the present invention is that a barrier material having standard or defined, i.e., not customized, dimensions, can be provided for openings. The barrier material includes a "pinch loop" to reduce the length of the edge of the barrier material when the edge of the barrier material is attached to the frame. The ability to "pinch" the edge of the barrier material allows a certain latitude on the dimensions of the barrier material and yet still provides the appearance of a customized flat or taut barrier when the material is placed on the frame of the opening. Therefore, the barrier material does not have to be precisely custom fitted for individual openings.

Preferably, the barrier is substantially made of a screen material to enhance the features of allowing air and light to circulate between the room and the outside, or between two rooms.

The present invention therefore advantageously provides a barrier attachment for an opening, which barrier attachment is detachable and provides a "customized" appearance.

The barrier attachment also has the advantage of being able to roll up out of the way of the opening and yet still be attached to the top edge of the opening for self-storage. The barrier does not interfere with the operation of garage doors or other electrical or manual doors affixed to the opening when the barrier is in place. Because of the clearance of the barrier when it is properly installed, the barrier can be left in fully extended position when the garage or other door is being closed or opened. Additionally, the barrier is able to accommodate odd-shaped openings, i.e., imperfect door jambs, and still provide a custom appearance.

Other features, objects and advantages of the invention will be disclosed with reference to the figures and the detailed description of the invention.

DETAILED DESCRIPTION OF THE INVENTION

Figure 1:
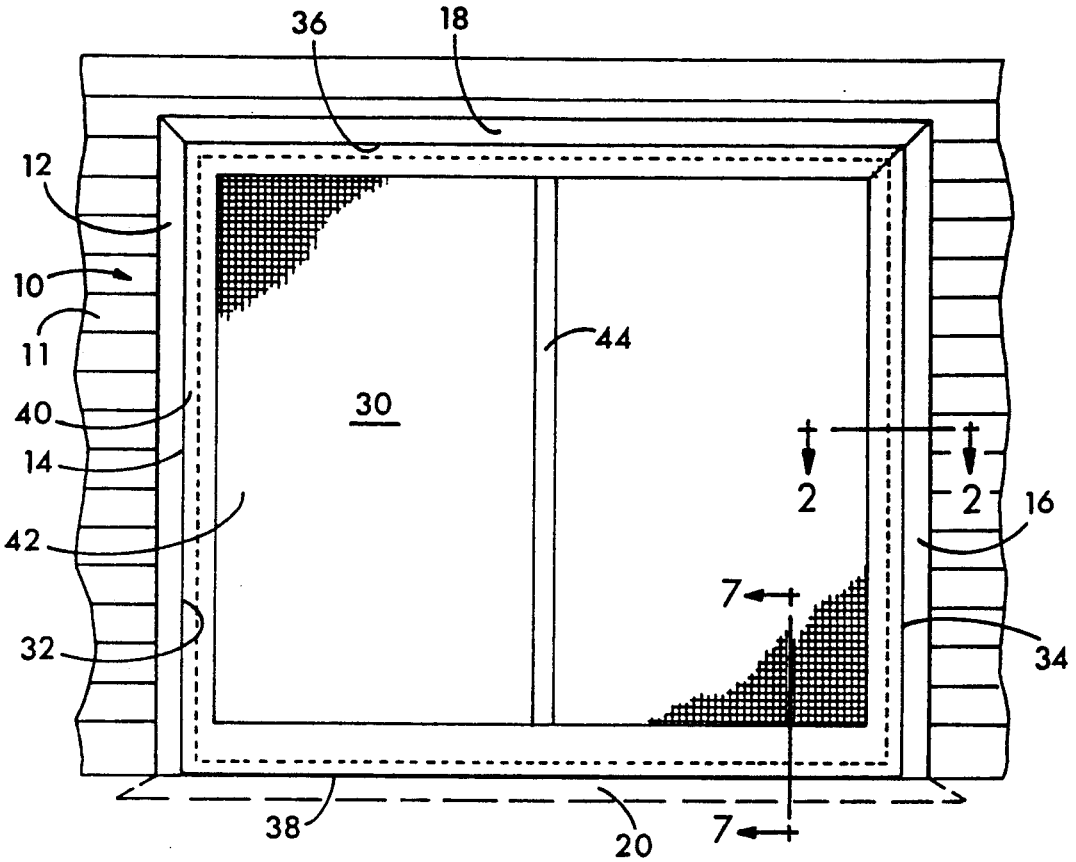
FIG. 1 is a side elevated view of the barrier of the present invention attached to the frame of an opening.

Referring now to the figures, wherein the same or similar structures are designated by the same reference numbers, reference is now made to FIG. 1, which illustrates an opening 10 for a room, house, garage, or the like, generally designated by reference number 11. The opening 10 has a defined height and width. For purposes of the present invention, the opening 10 will be designated a garage door opening. It is, however, within the scope of the present invention to use the barrier system of the present invention for door openings, window openings and the like. It is also within the scope of the present invention to use the present invention in the form of a room barrier. Thus, the actual framework of the opening is not entirely necessary. It will become apparent from reading the entire disclosure of the present invention that the mechanism for attaching a barrier can also be attached to walls of a room to divide the room.

The opening 10 is bordered by a frame 12 having opposing left and right elongated side sections 14, 16, respectively, an elongated top section 18 and a bottom section 20. In the case of door and garage openings, the bottom section 20 is generally defined by the room floor. The left and right side sections 14, 16 are generally of the same length, and the top and bottom sections 18, 20 are also generally of the same length, although the length of the top and bottom sections 18, 20 does not necessarily have to be the same length as the left and right side sections 14, 16. The preferred opening 10 forms a rectangular appearance.

It is also within the scope of the present invention to use the barrier on an opening having unequal dimensions. Additionally, the elongated sections 14,16,18 and the botton section 20 comprising the frame 12 do not necessarily require straight-edge dimensions. The sections can be curved or rounded to accommodate a uniquely shaped opening, such as a circular or arched opening.

Located within the frame 12 is the barrier 30, which is designed to detachably connect to the frame 12 of the opening 10. The barrier is comprised of a flexible material having a defined length and width. The barrier 30 is bordered by opposing left and right edges 32, 34, respectively, and opposing top and bottom edges 36, 38, respectively. In this manner, the left edge 32 of the barrier 30 is designed to be releasably attached to the left section 14 of the frame 12, the top edge 36 of the barrier 30 is designed to be releasably attached to the top section 18 of the frame 12, and the right edge 34 of the barrier 30 is designed to be releasably attached to the right section 16 of the frame 12.

Although not generally preferred, especially in the case of openings 10 for doorways and garages, the bottom edge 38 of the barrier 30 can also be releasably attached to the bottom section 20.

The material comprising the barrier 30 should be flexible, yet resistant to weather elements and rough use. Examples of suitable materials for the barrier 30 include canvas, rubber-coated canvas, other forms of treated canvas, nylon, and rip-stop nylon.

The barrier 30 may be formed of one sheet of the same material. Alternatively and preferably, the barrier 30 includes a border 40 surrounding an interior portion 42 formed of a different material, preferably a screening material, as illustrated. The screening material advantageously allows air to traverse the barrier and yet inhibit the passage of undesirable elements, such as insects.

The dimensions of the border 40, the interior portion 42 and the resulting dimensions of the barrier 30 may be modified according to the needs and desires of the user. A support strip 44 may also be added to the barrier 30 to provide added support.

An added advantage of the barrier 30 of the present invention is that length and width of the barrier 30 do not necessarily have to conform to the dimensions of the frame 12. In order to provide partial access of desirable elements such as air and light while inhibiting the access of insects or other undesirable elements, the length of the edges 32, 34, 36, 38 of the barrier 30 should be the same or at least slightly larger than the length of the sections 14, 16, 18, 20 of the frame 12.

Referring now to FIGS. 2-5, the mechanism for attaching the barrier 30 to the frame 12 and for customizing the dimensions of the barrier 30 to the frame 12 will now be described. In order to attach the barrier 30 to the frame 12, an attachment mechanism must be added to both the edges of the barrier 30 and the frame 12. A preferred attachment mechanism should be easy to install, convenient to use, and blend with the opening 10 in order avoid detracting from the appearance of the opening 10.

The preferred attachment is a hook and pile attachment device commonly known to the art as VELCRO®. The VELCRO® attachment incorporates two pieces or strips of material, which readily and releasably attach to each other. One piece includes pile material, and the other piece includes a series of hooks designed to grasp the pile. Other attachments, known to the art, include snaps, buttons, zippers, and tacks. The basic requirement for a suitable attachment mechanism is that it must have a first frame attachment portion and a second barrier attachment portion.

Figure 2:
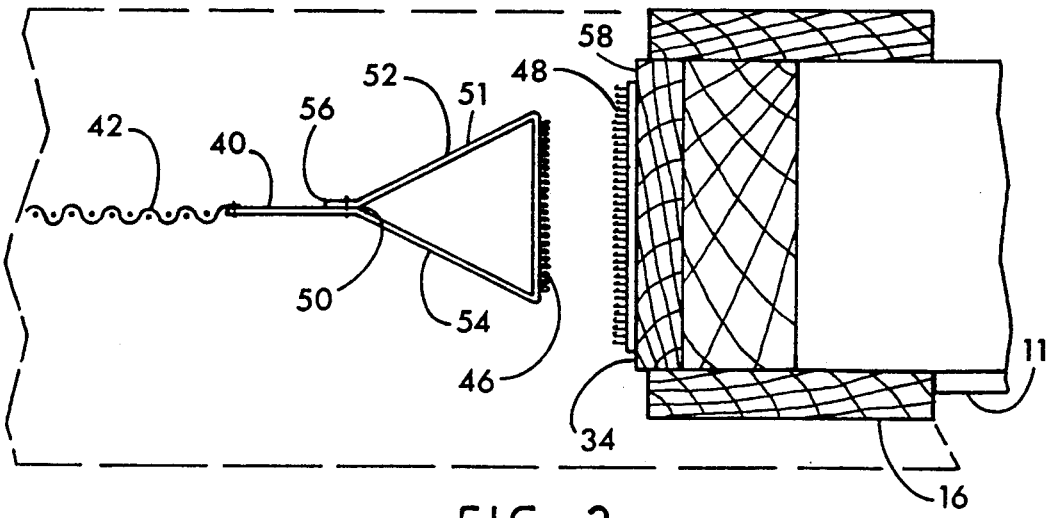
FIG. 2 is a cross-sectional view of attachment feature of the barrier, taken along lines 2—2 of FIG. 1.

Reference is now made to FIG. 2, which illustrates the preferred mechanism for attaching the barrier 30 to the frame 12 by a VELCRO® attachment. Although FIG. 2 relates to the right section 16 of the frame 12 for illustrative purposes, the mechanism for attaching the barrier to the frame 12 is the same throughout the length of the frame. A first barrier attachment mechanism, illustrated as having a hook strip 48, is attached to the interior of the frame, preferably along the left and right sections 14, 16, and the top section 18, by adhesive, staples, tacks or the like. The edge of the barrier 30 is then provided with a second barrier attachment mechanism, illustrated as having a pile strip 46. It is within the scope of the present invention to switch the pile strip and hook strip to the second and first attachment mechanisms respectively.

To properly place the pile strip 46 on the border 40 of the barrier 30, the border 40 is preferably bifurcated at position 50 into a flexible triangular pattern 51 having equal sides 52, 54 and the barrier edge 34, to which the pile strip 46 is attached. The triangular pattern 51 may be formed by attaching the end 56 of the barrier 30 material to the barrier 30 at position 50 by sewing, gluing, stapling or other means of attachment. In this manner the pile strip 46, which is similarly attached to the barrier material, extends from the barrier 30 in a perpendicular fashion to accommodate the interior edge 58 of the right side section 16 of the frame 12.

Once the hook strip 48 has been attached to the frame 12, the barrier 30 is attached to the frame 12 by securing the pile strip 46 attached to the edge 34 to the hook strip on the opening. The pile strip 46 is attached to the hook strip 48 in a progressive manner along all of the edges 14, 16, 18, and 20 if desired, until the barrier 30 is completely attached to the frame 12 of the opening 10 as illustrated in FIG. 1.

Figure 5:
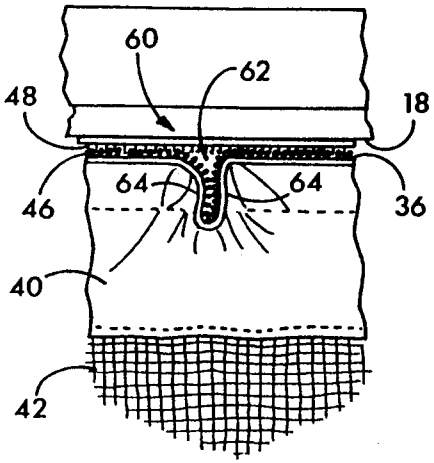
FIG. 5 is a front perspective view of a portion of the barrier of FIG. 3 taken along lines 5—5.
Figure 3:
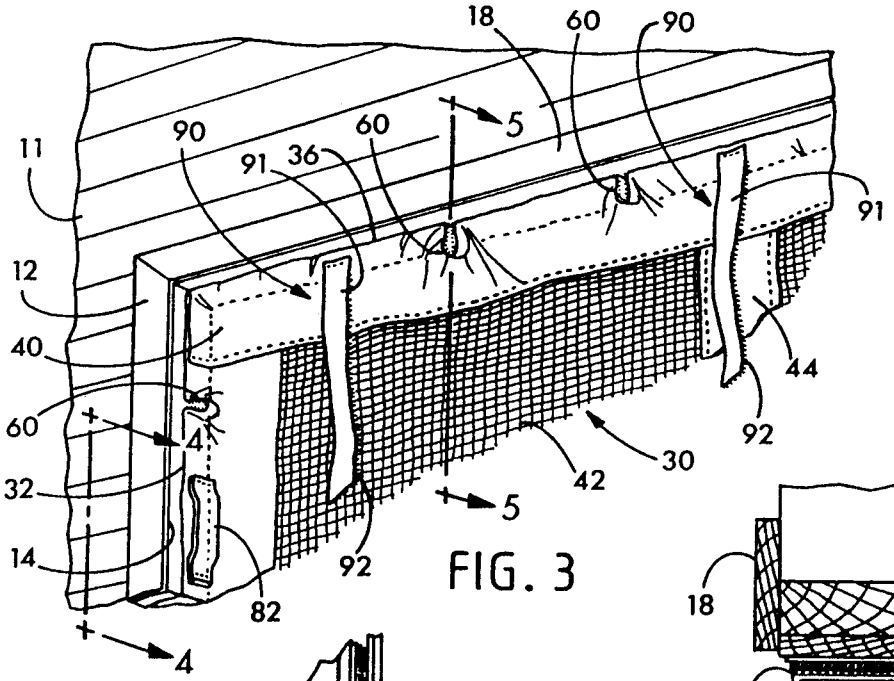
FIG. 3 is a partial perspective view of a portion of the barrier of the present invention illustrating the attachment of the barrier to the frame of the opening.

If any of the edges 32, 34, 36 or 38 of the barrier 30 is longer than the sections 14, 16, 18 or 20 of the frame 12, the edges of the barrier 30 may be customized by providing one or more pinch loops 60 in the desired edge of the barrier 30 as illustrated in FIGS. 3 and 5. It is within the scope of the present invention to provide as many or few of the pinch loops 60 as necessary to adjust the barrier 30 onto the frame 12 so that barrier material has a taut, wrinkle-free appearance generally associated with custom barriers. It is preferable to provide several small pinch loops 60 along the edges of the barrier 30 rather than one or two large pinch loops. In this manner, the integrity of the attachment of the barrier 30 to the frame 12 will be maintained while preventing an unwanted access opening, shown in FIG. 5 at 62 for illustrative purposes, at the location of the pinch loop for insects and other undesirable elements to pass through.

A preferred pinch loop 60 has a side 64 between approximately one-half and one inch in length. As discussed previously, the preferred practice is to use several pinch loops 60 with shorter sides 64 rather than one pinch loop 60 with long sides 64.

The pinch loops 60 are added to the barrier 30 after the barrier 30 is substantially fitted to the frame 12. At this point the installer can make a visual assessment of the fit between the barrier 30 and the frame 12. If any of the edges of the barrier 30 is longer than the elongated sections of the frame 12, the installer can customize the barrier edges to the length of the elongated sections by providing pinch loops 60 to the affected edge. The pinch loops 60 are installed by pinching the edge of the barrier 30, for example with the installer's thumb and forefinger, to create opposing sides 64 of pile strips 46. Because the opposing sides 64 of the same pile strip material will not attach to each other, it is important to limit the length of the sides 64. The pinch loops 60 takes up any slack in the edge of the barrier 30 provided by the difference in length between the barrier edge and the elongated section of the frame 12. Properly applied, the pinch loop 60 will not be readily detectable to the casual observer; no access opening 62 will be present; and the barrier 30 will not look wrinkled on the frame 12 of the opening 10.

Figure 7:
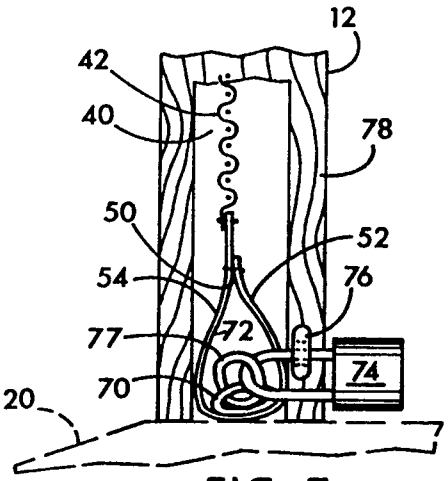
FIG. 7 is partial cross-sectional view of the barrier, taken along lines 7—7 of FIG. 1, illustrating a means for securing the lower barrier edge to the frame.

While the bottom edge 38 of the opening 10 may also be provided with an attachment mechanism described previously, it is preferred to provide a gravity weight 70, illustrated in FIG. 7, in order to maintain the integrity of the attachment between the bottom edge 38 and the floor 20 of the opening. The weight 70 may be in the form of lead or other heavy weights attached to the bottom frame of the barrier. Alternatively and as illustrated in FIG. 7, the bottom edge of the barrier may be provided with sides 52, 54 formed by bifurcated portion 50 to form a channel 72 through which a weighted chain or the like may pass. A weighted chain has the advantage of links to provide a means to secure the barrier 30 to the opening 10. As illustrated in FIG. 7, the locking means may be in the form of a padlock 74 which joins one link 77 of the chain 70 to a post 76 on a stud 78 of the frame 12.

The barrier 30 of the present invention may also be provided with a gripping handle 82 strategically placed along the edges of the barrier 30 to enable the user 83 to release the attachment mechanism and pull the barrier 30 from the frame 12. The opening 84 enables access between any edge on the barrier 30 and the frame 12. This is achieved by grasping the handle 82 and pulling the barrier 30 from the frame 12, thereby releasing the pile strip 46 from the hook strip 48 and providing an opening 84 through which the user 83 may enter. The barrier 30 may then be easily attached to the frame 12 in the manner described previously.

Figure 6:
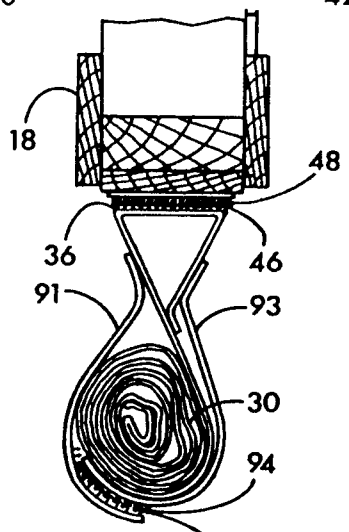
FIG. 6 is a side cross-sectional view of the barrier showing it rolled for partial storage.
Figure 4:
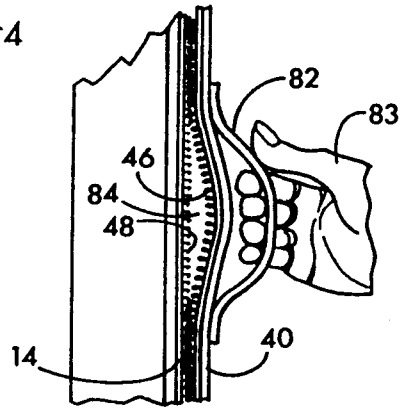
FIG. 4 is a side elevated view of a portion of the barrier of the present invention, taken along lines 4—4 of FIG. 3, illustrating the handle opening and a method of detaching the barrier from the frame.

Additionally, the barrier 30 may be provided with one or more securing mechanisms 90, illustrated in FIGS. 3 and 6, to secure a rolled barrier 30 to an edge of the frame 12. Preferably, the securing mechanisms are attached to the top edge 18. The mechanism 90 includes a first strap 91, on one side of the barrier 30, having a first attachment means or hook strip 92 and a second strap 93, on the other side of the barrier 30, having a second attachment means or pile strap 94. The straps 91, 93 are designed to overlap such that the hook strip 92 interlocks with the pile strap 94 to trap the rolled barrier 30 as illustrated in FIG. 6.

It is understood that the invention is not confined to the particular construction and arrangement herein illustrated and described, but embraced such modified forms thereof as come within the scope of the following claims.

What is claimed is:

1. A screen for a garage door opening having a jamb with inwardly facing surfaces, wherein a garage door is moveable between an open position and a closed position, the screen comprising:

a. a flexible insect barrier having a body defined by opposing top and bottom edges and opposing side edges, wherein substantial portions of the barrier body are formed of screen material to allow air flow therethrough;

b. a flexible border attached to the top and side edges of the barrier, wherein the border is a flexible strip of material which extends outwardly from the insect barrier towards the jamb, the border having a first portion which extends substantially perpendicular to the insect barrier, and a second portion substantially coplanar with the barrier and a third portion which extends between the first and second portions and which is connected to the first portion frontwardly of the second portion, and wherein the first portion extends both frontwardly and rearwardly of the second portion;

c. a first part of a two part hook and pile fastener attached to the border side portions such that the fastener first part extends substantially perpendicular to the barrier;

d. a second part of a two part hook and pile fastener which is attached to the inwardly facing surfaces of a garage door jamb frontwardly of a movable garage door, wherein the second part fastener is releasably engaged with the first part fastener to connect the barrier to the garage door jamb, such that the garage door is rearward of the barrier and may thus be closed without substantially disturbing the barrier.

2. The garage door screen of claim 1, wherein the border comprises a triangular channel, with a fourth segment extending between the first segment and the second segment, the fourth segment being attached to the first segment at a position rearward of the second segment.

* * * * *